United States Patent [19]

Long

[11] 4,185,829

[45]. Jan. 29, 1980

[54] CHANCE DEVICE MOUNTABLE ON PHONOGRAPH TURNTABLE

[76] Inventor: Ben Long, 4911 Brooklyn Blvd., Minneapolis, Minn. 55429

[21] Appl. No.: 907,720

[22] Filed: May 19, 1978

[51] Int. Cl.[2] ..... A63F 5/02

[52] U.S. Cl. ..... 273/142 K

[58] Field of Search ..... 273/142 K, 142 D, 142 E, 273/142 F, 142 G, 110, 115, 123 R; 272/31 P; D34/5 K, 5 MM, 15 W; 273/142 R, 142 A, 142 B, 142 C, 142 H, 142 HA, 142 J, 142 JA, 142 JB, 142 JC, 142 JD

[56] References Cited

U.S. PATENT DOCUMENTS

| | | | |
|---|---|---|---|
| 434,721 | 8/1890 | Peters | 273/123 R |
| 608,918 | 8/1898 | Scovell | 273/110 |
| 1,292,228 | 1/1919 | Avery et al. | 273/115 |
| 1,532,160 | 4/1925 | Seymour | 273/142 F |
| 1,768,016 | 6/1930 | Walker | 273/110 X |
| 1,990,859 | 2/1935 | Elliott | 273/110 |
| 3,232,619 | 2/1966 | Burk | 273/123 R |

FOREIGN PATENT DOCUMENTS

| | | | |
|---|---|---|---|
| 276468 | 7/1914 | Fed. Rep. of Germany | 273/142 E |
| 917175 | 8/1954 | Fed. Rep. of Germany | 273/142 E |
| 759991 | 2/1934 | France | 273/110 |
| 20943 | of 1889 | United Kingdom | 273/110 |

*Primary Examiner*—Richard C. Pinkham
*Assistant Examiner*—Arnold W. Kramer
*Attorney, Agent, or Firm*—Williamson, Bains, Moore & Hansen

[57] ABSTRACT

A game device includes a circular, somewhat rigid game structure having a substantially flat upper playing surface and a lightweight ball which is movable along the upper surface. The game structure has a central opening therein and is adapted to be positioned upon and is revolvable with the turntable of a phonograph. A plurality of circumferentially arranged spaced apart posts are affixed to the game structure adjacent the periphery thereof, the spacing between each adjacent pair of posts being slightly less than the diameter of the ball. A plurality of small deflector elements project upwardly from the upper surface for the purpose of deflecting movement of the ball. Indicia is located between adjacent pairs of posts.

6 Claims, 3 Drawing Figures

CHANCE DEVICE MOUNTABLE ON PHONOGRAPH TURNTABLE

SUMMARY OF THE INVENTION

This invention relates to a game device and more particularly to a game device which is mounted on a phonograph turntable and is playable in conjunction with rotation of the turntable.

An object of this invention is to provide a novel game device, of simple and inexpensive construction which, during use thereof, requires rotating movement and which is adapted to be readily mounted on a phonograph turntable to be rotated thereby.

A more specific object of this invention is to provide a circular game structure mountable on and rotatable with a phonograph turntable, and a lightweight ball which is dropped upon the surface of the game structure to be impelled outwardly by centrifugal force for engagement between a random pair of a plurality of posts mounted on the perpihery of the game structure.

These and other objects and advantages of this invention will more fully appear from the foregoing description made in connection with the accompanying drawings, wherein like reference characters refer to the same or similar parts throughout the several views.

FIGURES OF THE DRAWINGS

DESCRIPTION OF THE PREFERRED EMBODIMENT

Figure 1:
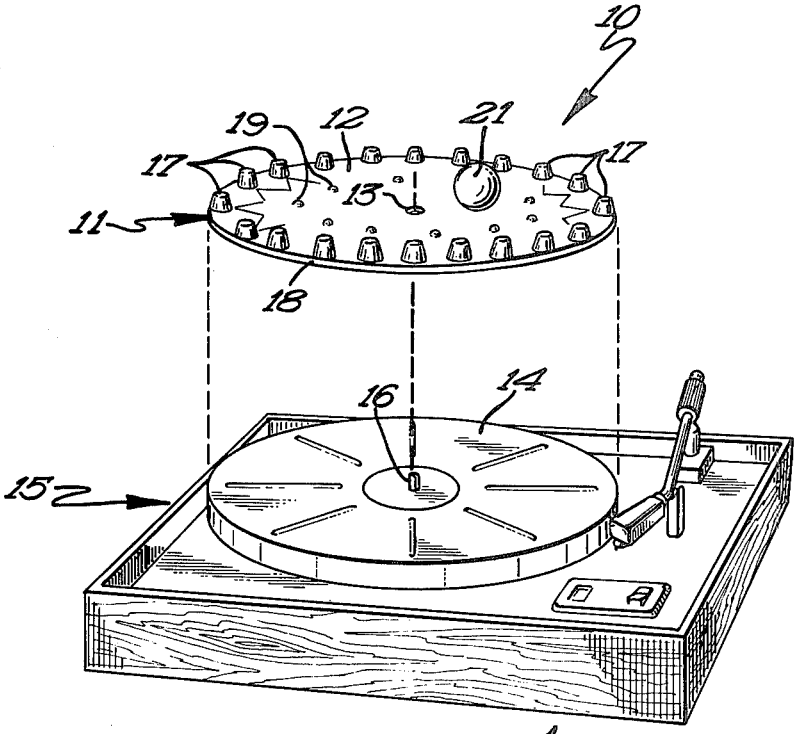
FIG. 1 is an exploded perspective view of the novel game device illustrating the manner in which it is mounted on the turntable of a conventional phonograph.
Figure 2:
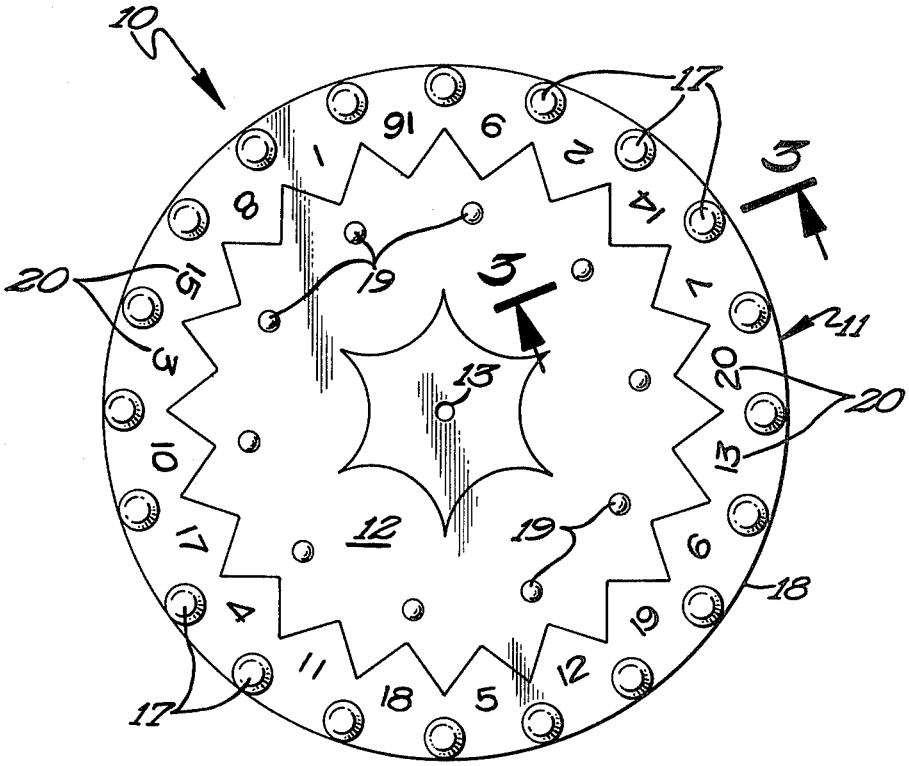
FIG. 2 is a top plan view of the novel game device.
Figure 3:
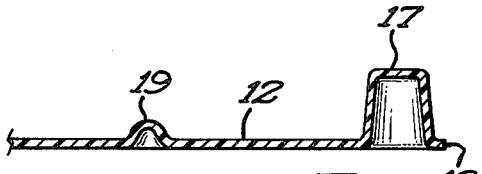
FIG. 3 is a cross-sectional view taken approximately along lines 3—3 of FIG. 2 and looking in the direction of the arrows.

Referring now to the drawings and more particularly to FIG. 1, it will be seen that one embodiment of the novel game device, designated generally by the reference numeral 10, is thereshown. The game device 10 includes a generally circular, substantially flat game structure or body 11 which is formed of a rigid material, preferably plastic, although other suitable rigid materials may be used. The game structure 11 has a substantially flat upper playing surface 12 and it is preferred that this surface be smooth and have a low coefficient of friction and many moldable plastic materials have such properties.

The game device 10 is rotated during use thereof and is therefore used in conjunction with the turntable of a conventional phonograph. To this end, the game structure 11 is provided with a central opening 13 therein and is positioned upon the turntable 14 of a conventional phonograph 15, the post 16 of the turntable projecting through the central opening 13. The game structure 11 is preferably formed in a molding operation and is provided with a plurality of substantially indentical, spaced apart post elements 17 which project upwardly from the upper surface of the game structure adjacent the circumferential edge 18 thereof. It is pointed out that the post elements 17 are molded into the game structure 11 during the forming operation and it will be noted that the post elements are equally spaced apart throughout the entire periphery of the game structure. It will further be noted that post elements 17 are preferably spaced slightly inwardly from the circumferential edge 18 of the game structure.

The game structure 11 is also provided with a plurality of spaced apart deflector elements 19 which project upwardly from the upper surface 12 thereof. The deflector elements 19 are also molded into the game structure during the formation of the latter and are arranged randomly with respect to each other. The deflector elements are also disposed nonsymetrically with respect to the peripheral edge of the game structure 11, and are spaced inwardly from the peripheral edge and outwardly of the center of the game structure. It will also be noted that the deflector elements are relatively small compared to the post elements 17 and have a substantially smaller vertical dimension than the vertical dimension of the post elements. The upper surface 12 of the game structure 11 has indicia thereon which is arranged in circular fashion adjacent the marginal portions thereof. It will be noted that the indicia disclosed comprises a series of numbers, each number or indicium being positioned closely adjacent a pair of post elements 17 and at a point substantially midway between the associated pair of post elements 17. Although the indicia illustrated comprises numbers, it is pointed out that other indicia could also be used such as letters, symbols or the like.

The game device 10 also includes a lightweight ball 21, preferably a Ping Pong ball, which is dropped upon the upper surface 12 of the game structure during use of the game device. It is pointed out that the spacing between adjacent post elements 17 is slightly less than the diameter of the ball 21 and that the spacing between adjacent deflector elements 19 is substantially greater than the diameter of the ball. It is also pointed out that the vertical dimension of the post elements 17 are approximately one-half the diameter of ball 21 and are sufficient to prevent the ball from being impelled over the post elements. On the other hand, the vertical dimension of the deflector elements 19 are quite small and serve primarily to deflect the path of the ball as it is impelled outwardly.

During use, the game structure 11 will be placed upon the turntable 14 of the phonograph 15 and the latter will be turned on to revolve the turntable. As the turntable is revolved, the ball 21 will be dropped upon the upper surface of the turntable closely adjacent the central portion of the game structure and the ball will be impelled outwardly. When the ball has come to rest between a pair of the post elements 17, the turntable will be stopped. The number, letter or other indicia positioned between the two posts engaged by the ball will be noted and the next player will repeat this procedure. The game device may be adapted for playing many kinds of games, the object of which may be to spell words, accumulate a predetermined number total or the like.

From the foregoing description, it will be seen that my novel game device, which is of simple and inexpensive construction, may be adapted for playing many interesting types of games by persons of all ages.

While the preferred embodiments of the present invention have been described, it should be understood that various changes, adaptations and modifications may be made therein without departing from the spirit of the invention and the scope of the appended claims.

What is claimed is:

1. A game device adapted to be positioned on the turntable of a phonograph, said game device including:

a circular, substantially flat game structure corresponding to the turntable of a phonograph, said body having a centrally located opening therein for accommodating the post of the turntable therethrough, a light weight ball adapted to be dropped on the game structure when the latter is rotated while positioned on the turntable, a plurality of similar post elements affixed to the game structure adjacent the circumference thereof and projecting upwardly therefrom, said post elements being equally spaced apart, the spacing between adjacent posts being less than the diameter of the ball, a plurality of similar spaced apart deflector elements affixed to said game structure and projecting upwardly therefrom, said deflector elements being spaced inwardly from the post elements, the spacing between adjacent deflector elements being greater than the diameter of the ball whereby the latter may readily pass between the adjacent deflector elements, and indicia affixed to the upper surface of the game structure adjacent the circumference thereof, each indicium being located between adjacent pairs of said posts.

2. The game device as defined in claim 1 wherein said post elements have a vertical dimension substantially greater than the vertical dimension of the deflector elements.

3. The game device as defined in claim 1 wherein said deflector elements are randomly spaced apart.

4. The game device as defined in claim 1 wherein said game structure is formed of a molded plastic material, and said post and deflector elements are molded into said game structure.

5. The game device as defined in claim 4 wherein said post elements have a vertical dimension substantially greater than said deflector elements and said deflector elements being randomly spaced apart.

6. The game device as defined in claim 5 wherein said post elements each has a vertical dimension approximately equal to the radius of said ball.

* * * * *